US010912158B2

(12) United States Patent
Holzinger et al.

(10) Patent No.: US 10,912,158 B2
(45) Date of Patent: Feb. 2, 2021

(54) INDUCTION COOKING HOB

(71) Applicant: ELECTROLUX APPLIANCES AKTIEBOLAG, Stockholm (SE)

(72) Inventors: Jochen Holzinger, Rothenburg ob der Tauber (DE); Harald Hoffmann, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 92 days.

(21) Appl. No.: 15/778,394

(22) PCT Filed: Nov. 15, 2016

(86) PCT No.: PCT/EP2016/077706

§ 371 (c)(1),
(2) Date: May 23, 2018

(87) PCT Pub. No.: WO2017/093013

PCT Pub. Date: Jun. 8, 2017

(65) Prior Publication Data

US 2018/0352614 A1 Dec. 6, 2018

(30) Foreign Application Priority Data

Dec. 2, 2015 (EP) ..... 15197403

(51) Int. Cl.
*H05B 6/12* (2006.01)

(52) U.S. Cl.
CPC ..... *H05B 6/1218* (2013.01); *H05B 6/1263* (2013.01); *H05B 6/1272* (2013.01); *H05B 2213/03* (2013.01)

(58) Field of Classification Search
CPC ..... H05B 6/1218
(Continued)

(56) References Cited

U.S. PATENT DOCUMENTS 4,490,596 A * 12/1984 Hirai ..... H05B 6/1263 126/21 A
2006/0091135 A1* 5/2006 Kondo ..... H05B 6/1218 219/621

(Continued)

FOREIGN PATENT DOCUMENTS

CN 102297461 12/2011
EP 0861015 A2 8/1998

(Continued)

OTHER PUBLICATIONS

International Search Report & Written Opinion issues in corresponding PCT application No. PCT/EP2016/077706 dated Dec. 22, 2016, 11 pages.

(Continued)

*Primary Examiner* — Avinash A Savani
(74) *Attorney, Agent, or Firm* — Pearne & Gordon LLP

(57) ABSTRACT

The present invention relates to an induction cooking hob (10), in particular for a domestic appliance, comprising an optically transparent panel (12) for supporting cooking utensils, at least one illumination panel (14) arranged beneath the optically transparent panel (12), and at least one circuit board (18) arranged beneath the illumination panel (14), wherein said circuit board (18) includes a plurality of induction coils (16).

15 Claims, 6 Drawing Sheets

Figure 1:
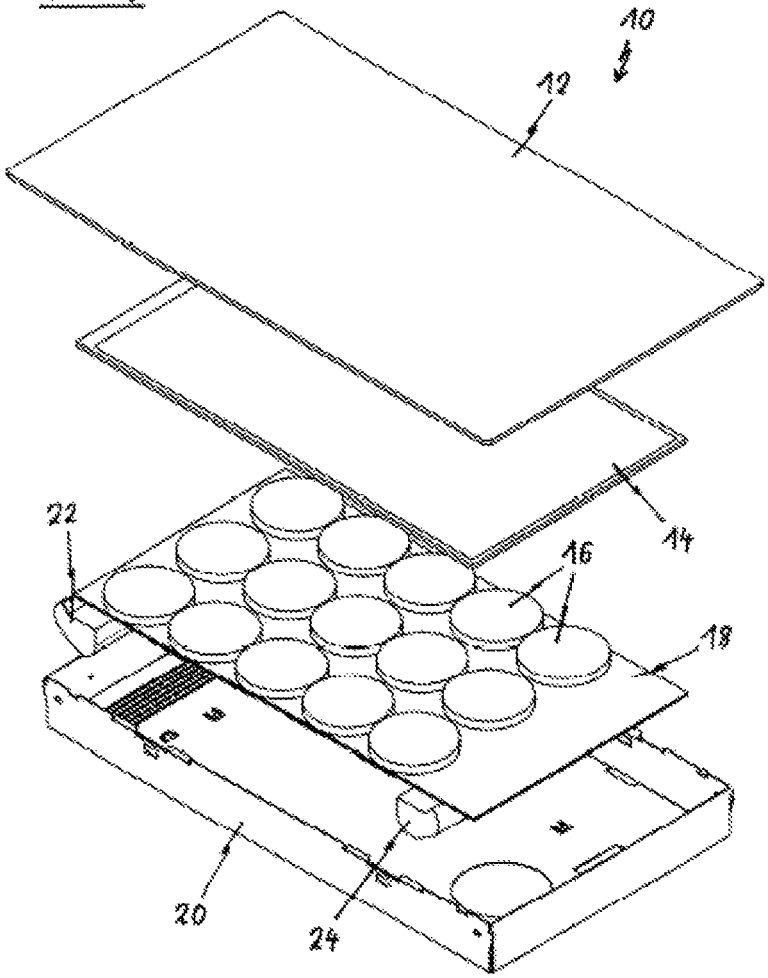

(58) Field of Classification Search
USPC ..... 126/213; 219/621
See application file for complete search history.

(56) References Cited

U.S. PATENT DOCUMENTS

| | | | | |
|---|---|---|---|---|
| 2009/0194527 | A1* | 8/2009 | Okada | H05B 6/1263 219/624 |
| 2016/0302265 | A1* | 10/2016 | Kreiner | H05B 6/666 |

FOREIGN PATENT DOCUMENTS

| | | | |
|---|---|---|---|
| EP | 2587165 | A1 | 5/2013 |
| EP | 2911473 | A1 | 8/2015 |
| JP | 5169970 | | 3/2013 |
| WO | 2008064993 | A1 | 6/2008 |

OTHER PUBLICATIONS

English translation of Chinese Office action for counterpart application No. CN 201680064008.1 dated Nov. 12, 2020, 10 pages.

* cited by examiner

INDUCTION COOKING HOB

The present invention relates to an induction cooking hob, in particular for a domestic appliance.

In an induction cooking hob an illumination device, for example single or multiple light emitting diodes, is used for indicating the cooking zones for the user. Usually, the light source elements are fixed, so that flexible cooking zones cannot be indicated. In the case of a full flexible induction cooking hob, the centres of the cooking zones can only be illuminated, when the induction coil is covered by a cooking utensil in order to obtain a feedback where the cooking utensil is located. However, in this case the light source is covered by the cooking utensil.

It is an object of the present invention to provide an induction cooking hob, which allows the indication of flexible cooking zones.

According to the present invention an induction cooking hob, in particular for a domestic appliance, is provided, which comprises

- an optically transparent panel, in particular a glass ceramic panel, for supporting cooking utensils,
- at least one illumination panel arranged beneath the optically transparent panel, and
- at least one circuit board arranged beneath the illumination panel, wherein said circuit board includes a plurality of induction coils.

The core of the present invention is the illumination panel beneath the optically transparent panel. The illumination panel allows an arbitrary illumination of the optically transparent panel. The illumination of the optically transparent panel by the illumination panel is independent of the arrangement and positions of the induction coils.

According to a preferred embodiment of the present invention, at least one pressure blower is arranged at a margin of the circuit board.

In a similar way, at least one suction blower may be arranged at a margin of the circuit board. Preferably, said suction blower is arranged opposite to the pressure blower.

In particular, an air stream is moved or movable between the illumination panel and the circuit board from an outlet of the pressure blower to an inlet of the suction blower, wherein preferably another air stream is moved or movable beneath the circuit board from an outlet of the suction blower to an inlet of the pressure blower. The pressure blower and suction blower cause that the air stream runs between the illumination panel and the circuit board from the outlet of the pressure blower to the inlet of the suction blower and the other air stream runs beneath the circuit board from an outlet of the suction blower to an inlet of the pressure blower.

The combination of the pressure blower and suction blower arranged at opposite margins of the circuit board allows an improved cooling beneath the optically transparent panel. The combination of the pressure blower and the suction blower guarantees a sufficient cooling of the illumination panel.

In particular, the illumination panel includes a plurality of light source elements arranged in a matrix form.

For example, the light source elements are light emitting diodes (LED).

Moreover, the illumination panel may include a plurality of light guide elements. For example, said light guide elements may distribute light from the light emitting diodes and/or other light source elements.

Further, the illumination panel may be a thin film transistor (TFT) panel.

Alternatively or additionally, the illumination panel may include at least one DOT matrix display.

Moreover, the induction cooking hob comprises a casing, wherein preferably said casing and the optically transparent panel form a closed or a substantially closed box.

In particular, the induction coils are arranged on a top side of the circuit board.

Further, a plurality of electronic circuit elements is arranged at a bottom side of the circuit board.

Preferably, a gap is formed between the optically transparent panel and the illumination panel, so that a further air stream runs between said optically transparent panel and illumination panel from the outlet of the pressure blower to the inlet of the suction blower.

In this case, the distance between the optically transparent panel and the illumination panel may be between 1 mm and 5 mm, preferably 2 mm.

Additionally, a temperature sensing foil is attached at the bottom side of the optically transparent panel in order to control the pressure blower and the suction blower.

The distance between the illumination panel and the induction coils may be between 1 mm and 5 mm, preferably 2 mm.

In particular, the pressure blower and/or the suction blower is an axial blower or are axial blowers, respectively, wherein a rotation axis of said axial blower extends parallel to the corresponding margin circuit board.

Preferably, neighboured induction coils are spaced from each other, so that gaps are formed between them. This increases the cross section of the air stream.

At last, a plurality of temperature sensors may be arranged as matrix inside the induction cooking hob, wherein said temperature sensors are provided for detecting the temperature of a cooking utensil upon the optically transparent panel.

In this case, the distance between neighboured temperature sensors is between 5 cm and 10 cm, preferably 7 cm.

Novel and inventive features of the present invention are set forth in the appended claims.

Figure 2:
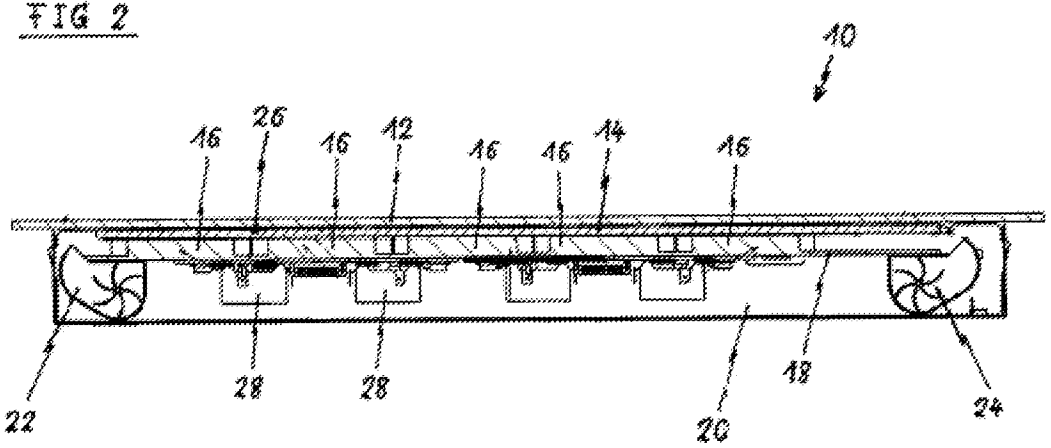
Figure 3:
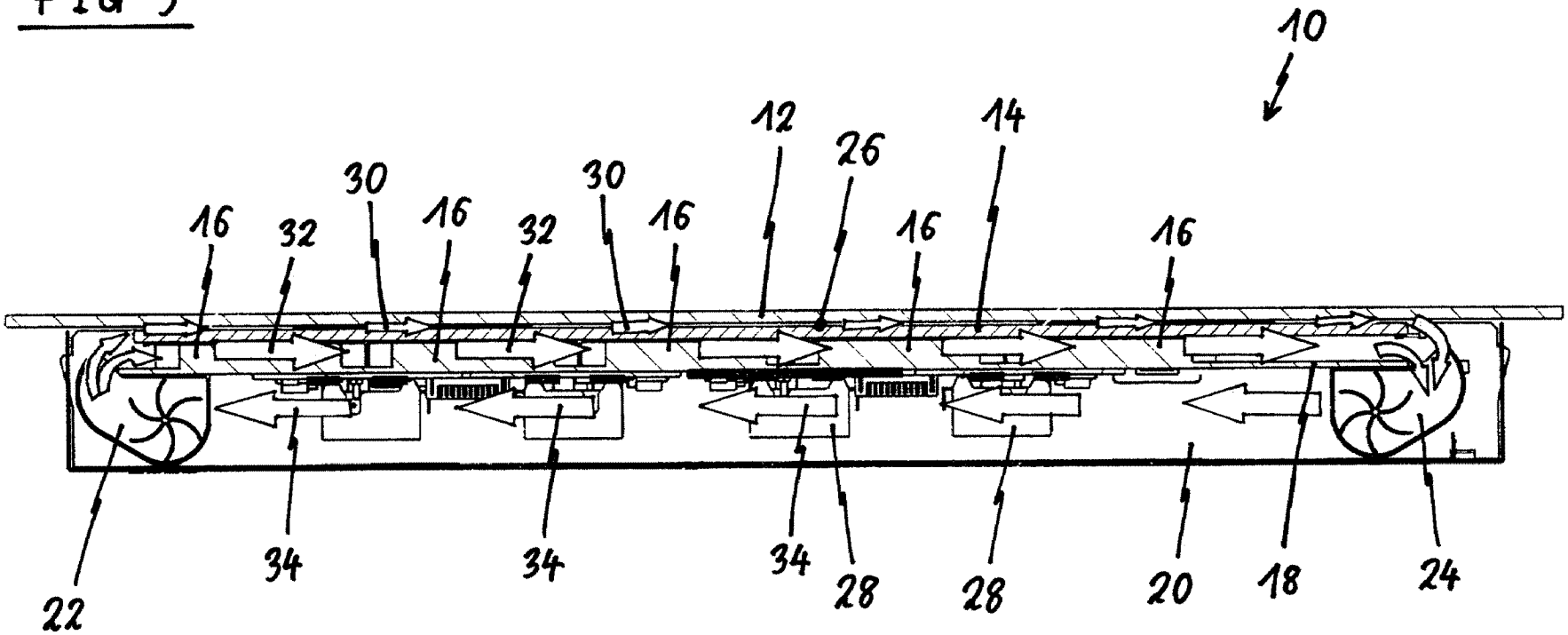
Figure 4:
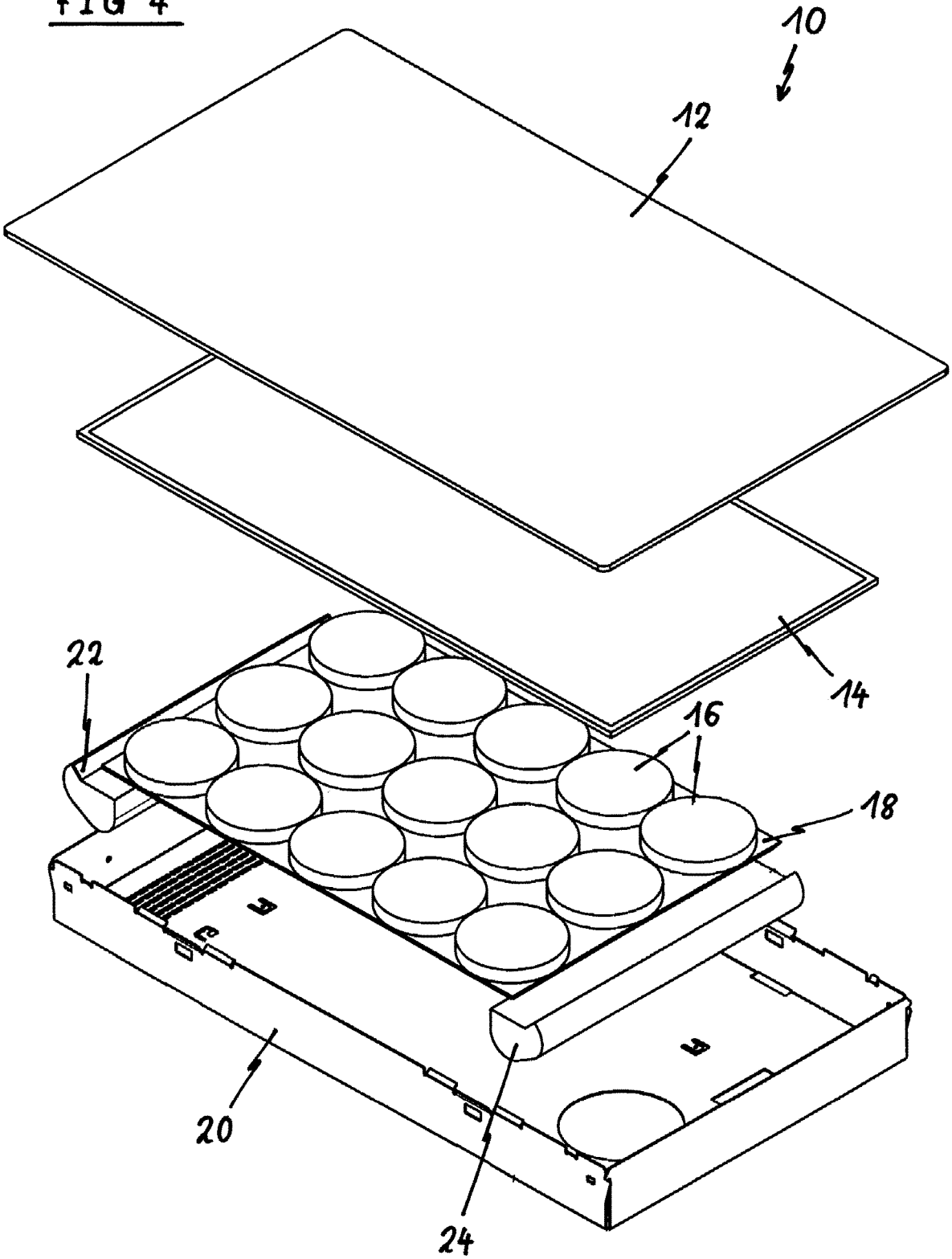
Figure 5:
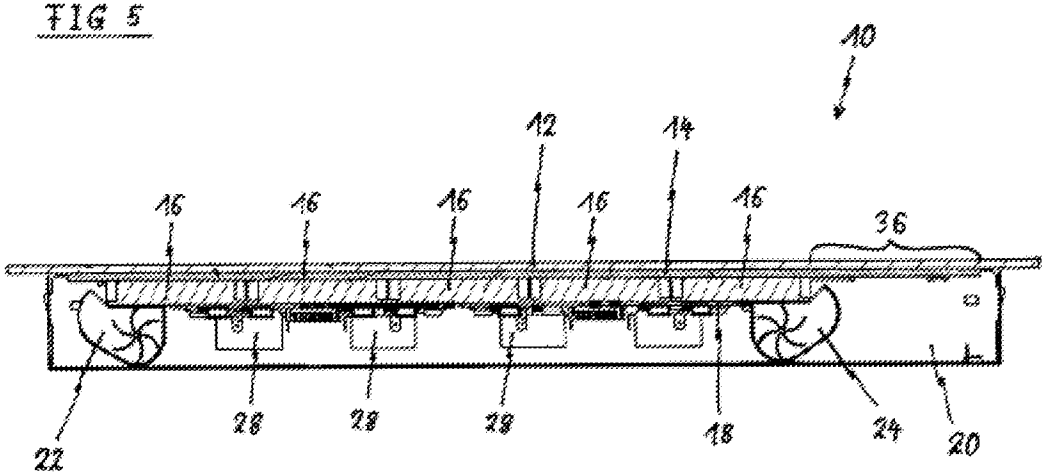
Figure 6:
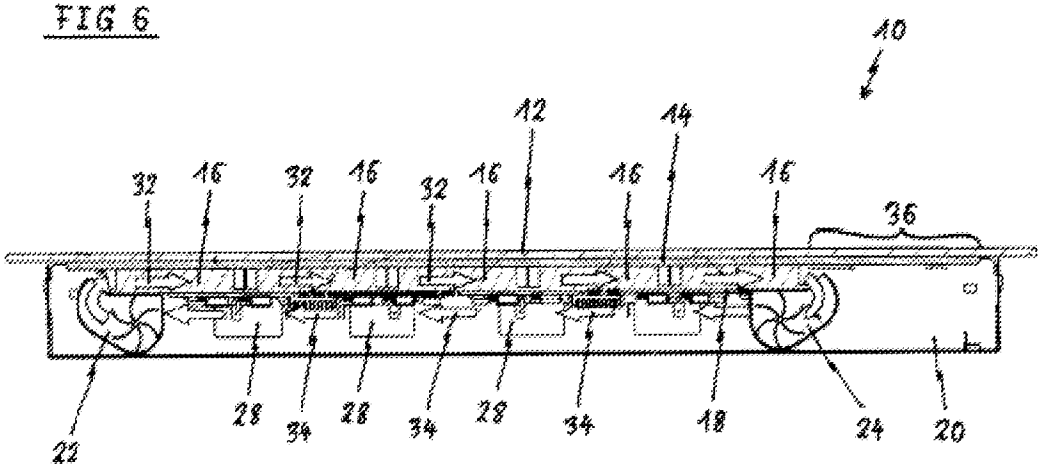

The present invention will be described in further detail with reference to the drawings, in which FIG. 1 illustrates a schematic exploded perspective view of an induction cooking hob according to a first embodiment of the present invention, FIG. 2 illustrates a schematic sectional side view of the induction cooking hob according to the first embodiment of the present invention, FIG. 3 illustrates a schematic sectional side view of the induction cooking hob according to the first embodiment of the present invention, FIG. 4 illustrates a schematic exploded perspective view of the induction cooking hob according to a second embodiment of the present invention, FIG. 5 illustrates a schematic sectional side view of the induction cooking hob according to the second embodiment of the present invention, and FIG. 6 illustrates a schematic sectional side view of the induction cooking hob according to the second embodiment of the present invention.

FIG. 1 illustrates a schematic exploded perspective view of an induction cooking hob 10 according to a first embodiment of the present invention.

The induction cooking hob 10 comprises a glass ceramic panel 12, an illumination panel 14, a plurality of induction coils 16, a circuit board 18, a casing 20, a pressure blower 22 and a suction blower 24. In this example, the induction cooking hob 10 comprises the glass ceramic panel 12. In general, the induction cooking hob 10 comprises an optically transparent panel 12. The casing 20 includes a bottom wall, four side walls and an open top side. The open top side of the casing 20 is covered by the glass ceramic panel 12, so that the casing 20 and the glass ceramic panel 12 form a closed or a substantially closed box. The illumination panel 14, the induction coils 16, the circuit board 18, the pressure blower 22 and the suction blower 24 are arranged inside the casing 20. In this example, the induction coils 16 are attached on the top side of the circuit board 18.

The illumination panel 14 is arranged beneath the glass ceramic panel 12. In turn, the circuit board 18 with the induction coils 16 is arranged beneath the illumination panel 14. The pressure blower 22 and the suction blower 24 are arranged at two opposite margins of the circuit board 18. In this example, the pressure blower 22 and the suction blower 24 are arranged at the both opposite narrow sides of the circuit board 18.

The illumination panel 14 is provided for illuminating the glass ceramic panel 12. In particular, the illumination panel 14 indicates heating zones on said glass ceramic panel 12. Preferably, the illumination panel 14 is an LED or TFT screen. The light emitting diodes (LED) are arranged as a matrix on the illumination panel 14. Each LED can be controlled separately. Additionally, the illumination panel 14 may include a plurality of light guide elements. Said light guide elements may distribute light from the light emitting diodes and/or other light source elements. The illumination of the glass ceramic panel 12 by the illumination panel 14 is independent of the arrangement and positions of the induction coils 16.

Further, the illumination panel 14 may include at least one DOT matrix display or may be formed as a DOT matrix display. In general, arbitrary suitable kinds of displays and illumination devices may be used for the illumination panel 14.

The pressure blower 22 and the suction blower 24 are provided for cooling the illumination panel 14. The combination of the pressure blower 22 and the suction blower 24 guarantees a sufficient cooling of the illumination panel 14. A temperature sensing foil may be attached at the lower side of the glass ceramic panel 12 in order to control the pressure blower 22 and the suction blower 24.

Further, a number a temperature sensors, which are not shown, may be arranged beneath the glass ceramic panel 12 and/or the illumination panel 14, in order to detect the temperatures of cooking vessels arranged upon the glass ceramic panel 12. For example, the temperature sensors are in a matrix form. The distances between neighboured temperature sensors are between 5 cm and 10 cm, preferably about 7 cm.

FIG. 2 illustrates a schematic sectional side view of the induction cooking hob 10 according to the first embodiment of the present invention.

The glass ceramic panel 12 covers the open top side of the casing 20. The illumination panel 14, the circuit board 18 with the induction coils 16, the pressure blower 22 and the suction blower 24 are arranged inside the casing 20. A gap 26 is formed between the glass ceramic panel 12 and the illumination panel 14. The distance between the glass ceramic panel 12 and the illumination panel 14 is at least 2 mm. The induction coils 16 are attached on the top side of the circuit board 18, while a plurality of electronic circuit elements 28 are attached at the bottom side of said circuit board 18. The distance between the induction coils 16 on the one hand and the illumination panel 14 on the other hand is at least 2 mm. The pressure blower 22 and the suction blower 24 are arranged at the opposite narrow sides of the circuit board 18.

FIG. 3 illustrates a schematic sectional side view of the induction cooking hob 10 according to the first embodiment of the present invention. FIG. 3 is similar as FIG. 2, wherein additionally air streams 30, 32 and 34 generated by the pressure blower 22 and the suction blower 24 are shown. The air streams are represented by the arrows 30, 32 and 34.

One air stream 30 occurs in the gap 26 between the glass ceramic panel 12 and the illumination panel 14. A further air stream 32 is formed between the illumination panel 14 and the circuit board 18. The air streams 30 and 32 extend from an outlet of the pressure blower 22 to an inlet of the suction blower 24. The air streams 30 and 32 run parallel to each other. Another air stream 34 is generated between an outlet of the suction blower 24 and an inlet of the pressure blower 22. Said air stream 34 extends between the circuit board 18 and the bottom wall of the casing 20. The air stream 34 runs antiparallel to the air streams 30 and 32.

FIG. 4 illustrates a schematic exploded perspective view of the induction cooking hob 10 according to a second embodiment of the present invention.

The induction cooking hob 10 comprises the glass ceramic panel 12, the illumination panel 14, the plurality of induction coils 16, the circuit board 18, the casing 20, the pressure blower 22 and the suction blower 24. The casing 20 includes the bottom wall, four side walls and the open top side, wherein said open top side is covered by the glass ceramic panel 12 and the casing 20 and the glass ceramic panel 12 form the closed or substantially closed box. The illumination panel 14, the induction coils 16, the circuit board 18, the pressure blower 22 and the suction blower 24 are arranged inside the casing 20, wherein the induction coils 16 are attached on the top side of the circuit board 18.

The illumination panel 14 is arranged beneath the glass ceramic panel 12, while the circuit board 18 with the induction coils 16 is arranged beneath the illumination panel 14. The pressure blower 22 and the suction blower 24 are arranged at two opposite margins of the circuit board 18. In this example, the pressure blower 22 and the suction blower 24 are arranged at the both opposite narrow sides of the circuit board 18.

The illumination panel 14 is provided for illuminating the glass ceramic panel 12, in particular for indicating the heating zones on said glass ceramic panel 12. Preferably, the illumination panel 14 is an LED or TFT screen. The pressure blower 22 and the suction blower 24 are provided for cooling the illumination panel 14, wherein the combination of the pressure blower 22 and the suction blower 24 guarantees a sufficient cooling of the illumination panel 14.

Additionally, a user interface area 36 is formed in a portion of the glass ceramic panel 12 and the illumination panel 14, wherein no induction coils are arranged.

FIG. 5 illustrates a schematic sectional side view of the induction cooking hob 10 according to the second embodiment of the present invention.

The glass ceramic panel 12 covers the open top side of the casing 20, while the illumination panel 14, the circuit board 18 with the induction coils 16, the pressure blower 22 and the suction blower 24 are arranged inside the casing 20. The illumination panel 14 is arranged directly beneath the glass ceramic panel 12 and the illumination panel 14, so that no gap is formed between said glass ceramic panel 12 and illumination panel 14. The induction coils 16 are attached on the top side of the circuit board 18, while the plurality of electronic circuit elements 28 are attached at the bottom side of said circuit board 18. The distance between the induction coils 16 on the one hand and the illumination panel 14 on the other hand is at least 2 mm. The pressure blower 22 and the suction blower 24 are arranged at the opposite narrow sides of the circuit board 18.

FIG. 6 illustrates a schematic sectional side view of the induction cooking hob 10 according to the second embodiment of the present invention. FIG. 6 is similar as FIG. 5, wherein additionally the air streams 32 and 34 are shown. The air streams 32 and 34 are generated by the pressure blower 22 and the suction blower 24.

One air stream 32 is formed between the illumination panel 14 and the circuit board 18 and extends from the outlet of the pressure blower 22 to the inlet of the suction blower 24. The other air stream 34 is generated between the outlet of the suction blower 24 and the inlet of the pressure blower 22. The air stream 34 extends between the circuit board 18 and the bottom wall of the casing 20. The air stream 34 runs antiparallel to the air stream 32.

The illumination panel 14 allows an arbitrary illumination of the glass ceramic panel 12. The illumination of the glass ceramic panel 12 by the illumination panel 14 is independent of the arrangement and positions of the induction coils 16. The combination of the pressure blower 22 and the suction blower 24 guarantees a sufficient cooling of the illumination panel 14.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 induction cooking hob
12 glass ceramic panel
14 illumination panel
16 induction coil
18 circuit board
20 casing
22 pressure blower
24 suction blower
26 gap
28 electronic circuit element
30 air stream
32 air stream
34 air stream
36 user interface area

The invention claimed is:

1. An induction cooking hob, comprising:

an optically transparent panel for supporting cooking utensils, at least one illumination panel arranged beneath the optically transparent panel, at least one circuit board arranged beneath the illumination panel, wherein said circuit board includes a plurality of induction coils;

at least one pressure blower arranged at a margin of the circuit board, and at least one suction blower arranged at a margin of the circuit board opposite from said at least one pressure blower, wherein a gap is formed between the optically transparent panel and the illumination panel so that a further air stream runs between said optically transparent panel and said illumination panel from an outlet of the pressure blower to an inlet of the suction blower, wherein a distance between the optically transparent panel and the illumination panel is between 1 mm and 5 mm, and wherein a temperature sensing foil is attached at a bottom side of the optically transparent panel in order to control the pressure blower and the suction blower.

2. The induction cooking hob according to claim 1, wherein an air stream is moved or movable between the illumination panel and the circuit board from an outlet of the pressure blower to an inlet of the suction blower.

3. The induction cooking hob according to claim 1, wherein the illumination panel includes a plurality of light source elements arranged in a matrix form.

4. The induction cooking hob according to claim 1, wherein the illumination panel is a thin film transistor (TFT) panel.

5. The induction cooking hob according to claim 1, wherein the induction cooking hob comprises a casing, wherein said casing and the optically transparent panel form a closed or a substantially closed box.

6. The induction cooking hob according to claim 1, wherein the induction coils are arranged on a top side of the circuit board.

7. The induction cooking hob according to claim 1, wherein a plurality of electronic circuit elements is arranged at a bottom side of the circuit board.

8. The induction cooking hob according to claim 1, wherein a distance between the illumination panel and the induction coils is between 1 mm and 5 mm.

9. The induction cooking hob according to claim 1, wherein the pressure blower and/or the suction blower is an axial blower or are axial blowers, respectively, wherein a rotation axis of each said axial blower extends parallel to the corresponding circuit board margin.

10. The induction cooking hob according to claim 1, wherein neighboring ones of said induction coils are spaced from each other so that gaps are formed between them.

11. The induction cooking hob according to claim 1, wherein a plurality of temperature sensors is arranged as matrix inside the induction cooking hob, wherein said temperature sensors are provided for detecting a temperature of a cooking utensil upon the optically transparent panel, and wherein a distance between neighboured temperature sensors is between 5 cm and 10 cm.

12. The induction cooking hob according to claim 1, said suction blower being arranged opposite to the pressure blower.

13. The induction cooking hob according to claim 2, wherein another air stream is moved or movable beneath the circuit board from an outlet of the suction blower to an inlet of the pressure blower.

14. An induction cooking hob, comprising an optically transparent panel and a casing having an open top covered by said optically transparent panel in order to form a substantially closed box therebetween, an illumination panel located beneath said optically transparent panel and being selected from among a TFT display, an LCD display and a dot-matrix display, and a circuit board comprising a plurality of induction coils on an upper surface thereof located beneath the illumination panel, said illumination panel and said circuit board being disposed in said casing, said illumination panel comprising an plurality of light source elements arranged in a matrix and effective to illuminate said optically transparent panel independent of any arrangement or position of said induction coils, a pressure blower in said casing and a suction blower opposite said pressure blower in said casing, gap of at least 2 mm between said optically transparent panel and said illumination panel defining a first cooling pathway from an outlet of said pressure blower to an inlet of said suction blower, a first spacing of at least 2 mm between said illumination panel and said induction coils defining a second cooling pathway from said outlet of said pressure blower to said inlet of said suction blower, and a second spacing between a bottom surface of said circuit board and a bottom wall of said casing defining a return pathway from an outlet of said suction blower to an inlet of said pressure blower, wherein in operation first and second parallel air streams can be delivered via the respective first and second cooling pathways from said outlet of said pressure blower to said inlet of said suction blower, and a return air stream can be delivered via the return pathway from said outlet of said suction blower to said inlet of said pressure blower, wherein said return air stream will be antiparallel to said first and second air streams.

15. The induction cooking hob according to claim 14, wherein the optically transparent panel is a glass ceramic panel, the induction cooking hob further comprising a temperature-sensing foil attached at a lower side of the glass ceramic panel in order to control said pressure blower and said suction blower, and a plurality of temperature sensors arranged in a matrix beneath the glass ceramic panel and/or beneath the illumination panel in order to detect temperatures of one or a plurality of cooking vessels arranged upon the glass ceramic panel during use.

* * * * *